US005600975A

United States Patent [19]

McClain et al.

[11] Patent Number: 5,600,975

[45] Date of Patent: Feb. 11, 1997

[54] PROCESS AND APPARATUS FOR TREATING CELLULOSIC FIBER-CONTAINING FABRIC

[75] Inventors: David R. McClain, Williamsburg; Ewart H. Shattuck, Cincinnati, both of Ohio

[73] Assignee: American Textile Processing, L.L.C., Cincinnati, Ohio

[21] Appl. No.: 357,279

[22] Filed: Dec. 13, 1994

Related U.S. Application Data

[62] Division of Ser. No. 644,947, Jan. 23, 1991, Pat. No. 5,376,144.

[51] Int. Cl.[6] ..... D06B 1/02

[52] U.S. Cl. ..... 68/5 C; 68/6; 68/5 D

[58] Field of Search ..... 68/6, 5 C, 5 D, 68/59; 223/51

[56] References Cited

U.S. PATENT DOCUMENTS

| | | | |
|---|---|---|---|
| Re. 30,860 | 2/1982 | Swidler et al. . | |
| 3,653,805 | 4/1972 | Gamarra et al. . | |
| 3,660,013 | 5/1972 | Payet et al. . | |
| 3,706,526 | 12/1972 | Swidler et al. . | |
| 3,709,005 | 1/1973 | Keating | 68/6 |
| 3,709,657 | 1/1973 | Hollies et al. . | |
| 3,712,086 | 1/1973 | Payet et al. . | |
| 3,837,799 | 9/1974 | Wilson et al. . | |
| 3,865,545 | 2/1975 | Forg et al. . | |
| 3,884,632 | 5/1975 | Payet et al. . | |
| 3,951,595 | 4/1976 | Shelton . | |
| 3,952,595 | 4/1976 | Poolman et al. . | |
| 3,960,482 | 6/1976 | Payet . | |
| 3,960,483 | 6/1976 | Payet . | |
| 4,032,294 | 6/1977 | Thompson et al. . | |
| 4,067,688 | 1/1978 | Payet . | |
| 4,096,714 | 6/1978 | Nirenberg . | |
| 4,104,022 | 8/1978 | Payet . | |
| 4,113,936 | 9/1978 | Lesas et al. . | |
| 4,118,526 | 10/1978 | Gregorian et al. . | |
| 4,204,054 | 5/1980 | Lesas et al. . | |
| 4,204,055 | 5/1980 | Lesas et al. . | |
| 4,208,173 | 6/1980 | Gregorian et al. . | |
| 4,266,976 | 5/1981 | Gregorian et al. . | |
| 4,334,877 | 6/1982 | Gregorian et al. . | |
| 4,539,008 | 9/1985 | Andrews et al. . | |
| 5,018,371 | 5/1991 | Riba | 68/56 |

*Primary Examiner*—Frankie L. Stinson
*Attorney, Agent, or Firm*—Bacon & Thomas

[57] ABSTRACT

A process and apparatus for treating fabric articles containing cellulosic material to provide control shrinkage and durable-press properties for the fabric includes a system for exposing the fabric to an aerosol mist that uniformly supplies a liquid cellulosic cross linking agent and moisture to the fabric. Optionally, a liquid catalyst can be incorporated in the aerosol mist, whereby each droplet of the aerosol mist contains liquid cellulosic cross linking agent, moisture and catalyst promoting cross linking agent. Exposure of the fabric to the aerosol mist containing moisture, cross linking agent and catalyst, the fabric is cross linked at an elevated temperature and subsequently cleaned of cross linking chemicals. The fabric can also be treated using an aerosol mist containing other liquid chemical agents. Equipment for carrying out the process essentially includes a chamber having aerosol mist generating nozzles in communication with the interior of the chamber and appropriate supplies for compressed air and liquid chemicals in communication with the nozzles. Appropriate ventilating and heating systems are associated with the chamber.

16 Claims, 3 Drawing Sheets

PROCESS AND APPARATUS FOR TREATING CELLULOSIC FIBER-CONTAINING FABRIC

This application is a Division of application Ser. No. 07/644,947, filed Jan. 23, 1991 now U.S. Pat. No. 5,376,144.

BACKGROUND OF THE INVENTION

1. Field of the Invention

This invention relates to a treatment of cellulosic fiber-containing fabric and articles made from such fabric with a cross linking agent in the presence of a catalyst to improve durable press and shrinkage resistance properties of the fabric.

2. Discussion of Related Art

Treatment of cellulosic fibers (e.g., cotton, linen, hemp, rayon, etc.) and blends of fibers including cellulosic fibers with a cross linking agent such as formaldehyde in the presence of a cross linking promoting catalyst such as sulphur dioxide to improve the durable press (i.e., crease resistance) and shrinkage properties of fabric and articles made of such fibers is well documented in published literature and well known to those skilled in the art of fiber treatment. The physical chemistry of the process is also well documented and the effect of the cross linking treatment on cellulosic containing fabric and articles of apparel made from such fabric has been researched and published extensively.

Exemplary prior art processes are described in the patent literature, where previous attempts have resulted in systems that are intended to solve some of the more practical problems of applying cross linking treatment to finished articles of apparel in a low cost, high volume (i.e., commercial scale) and efficient manner, as well as cross linking treatment systems generally for cellulosic material.

The problems intended to be solved by the prior art processes and systems are described in the various patents issued to inventors in this field, but this discussion is concerned with prior art systems for treating cellulosic and cellulosic blend fabrics that have been formed into finished articles of apparel and continuous lengths of such fabrics on a high volume, continuous production basis to improve the durable press and shrinkage resistance properties of the apparel and fabric.

One approach to treating cellulosic fabrics and articles made from such fabrics described in the patent literature involves treating garments in a closed chamber using a gaseous cross linking agent with steam and a gaseous catalyst, such as is described in U.S. Pat. Nos. 3,660,013 and 3,712,086 issued to G. Payet and J. Forg on May 2, 1972 and Jan. 23, 1973, respectively. This process involved the generation of gaseous phase cross linking agent by heating powder of solid para-formaldehyde in a chamber containing the garments to be treated and then mixing the gas with steam and a gaseous cross linking promoting catalyst such as sulphur dioxide in the chamber so that the mixture permeates the garments therein. The temperature in the chamber is then reduced for a period of time and the temperature in the chamber is then increased to the cross linking temperature of the fabric and cross linking agent. While successful, this process has drawbacks in that heated trays used to vaporize formaldehyde required constant cleaning and maintenance, the moisture content of the fabric, while critical, was difficult to control, and excess formaldehyde absorbed into the fabric weakened the fabric and required careful cleaning of residual, non-cross linked formaldehyde from the garments after the cross linking procedures to avoid undesirable formaldehyde odors and irritant being left on the garments.

In U.S. Pat. No. 3,837,799 issued to K. W. Wilson, R. Swidler and J. P. Gamarra on Sep. 24, 1974, a process is described for crease proofing garments made from cellulosic fiber-containing fabric using gaseous formaldehyde generated by heating para-formaldehyde in mineral oil and subjecting cellulosic fiber-containing fabric with previously applied latent catalyst to the gaseous formaldehyde in a reaction chamber at about 90°–150° C. In this process, two controlled procedures are required to expose the fabric to catalyst and formaldehyde, the process is both temperature and moisture sensitive, and careful cleaning of the formaldehyde and water soluble catalyst from the fabric is required.

U.S. Pat. Nos. 3,960,482 and 3,960,483 issued to G. L. Payet on Jun. 1, 1976 describe a durable press involving a similar procedure for preconditioning fabric with a water soluble catalyst and then subjecting it to formaldehyde vapors and moisture before curing (cross linking) the fabric and formaldehyde at cross linking temperatures. The problems of the prior art systems are discussed in this patent, particularly the difficulties encountered in precisely controlling moisture content in the fabric in the presence of a toxic gas and a gaseous catalyst. In accordance with the process described in this patent, the moisture content of the cellulosic fibers is controlled so they have over 20% weight of moisture and contain a selected amount of catalyst when exposed to cross linking formaldehyde vapor. This enables the process to be carried out at a lower temperature (i.e., room temperature) with a drastically reduced concentration of formaldehyde (6% by volume) as compared with prior art procedures. This process, as with processes previously used, required separate moisture, formaldehyde and catalyst applications to the fabric, and also was highly dependent on the moisture content of the fabric for its successful implementation. The moisture was introduced into the fabric as a spray, mist or fog, or was padded on the fabric alone or with a catalyst. This left the problem of generating the gaseous cross linking agent and applying it to the fabric in a uniform manner as rapidly as possible. Presumably, the cross linking formaldehyde vapor used in accordance with the process described in the patent was generated from vaporizing solid form para-formaldehyde, which entailed maintenance problems already discussed above.

U.S. Pat. No. 3,865,545 issued to J. H. Forg and G. L. Payer describes an other process for treating cellulosic fiber articles to impart a durable press thereto involving vaporizing solid para-formaldehyde in a reaction chamber and exposing the fabric articles to the formaldehyde vapors, steam and gaseous catalyst for a period of time at a temperature initially ranging from 120° F. to about 145° F., followed by cooling the fabric 10°–30° by the time of completion of the procedure. Steam and free chemicals are then purged from the chamber before the temperature in the chamber is increased to cross linking temperature. Steam and fresh air are then circulated over the articles to clean them of residual odors. As in previously described processes, control over moisture content, cross linking agent concentration and catalyst content in the fabric as well as temperatures are all critical to some degree; vaporization of solid para-formaldehyde is difficult to control precisely; and the formaldehyde vapor generating system is maintenance intensive.

A process for the continuous treatment of continuous fabric and/or garments for improved durable press characteristics is described in U.S. Pat. No. 3,884,632 issued to G.

L. Payet and B. D. Brummet on May 20, 1975. In this patented system, the material to be treated was advanced through successive treating stations where it was sequentially moisturized, subjected to formaldehyde (generated by vaporizing solid para-formaldehyde) and catalyst, heated and cross linked, and cleaned in a continuous process.

U.S. Pat. No. 4,032,294 issued Jun. 28, 1977 to R. D. Thompson, D. Thompson and M. A. Beeley describes a similar process for continuously treating garments using a series of workstations and chambers to process equal sized batches of garments.

U.S. Pat. No. 3,706,526 issued on Dec. 19, 1972 to R. Swidler and K. Wilson describes a durable press process using formaldehyde and sulphur dioxide to treat cellulosic fabrics. Moisture content of the fabric is described as being very important to achieve a self-limiting reaction (cross linking) but moisture, gaseous formaldehyde and gaseous catalyst are all conveyed to the fabric by different routes and equipment, therefore requiring careful control over the system at all times to maintain proper proportioning of chemicals and moisture reaching the fabric.

U.S. Pat. No. 4,067,688 issued on Jan. 10, 1978 to G. L. Payet describes a durable press process for cellulosic fiber-containing fabrics using formaldehyde vapor and a liquid catalyst (aryl sulfonic liquid or acid)in a high moisture environment. The moisture, formaldehyde and catalyst generally are introduced to the fabric via different routes in the process, requiring careful control over operating parameters.

From the foregoing discussion, it is apparent that a simplified, cost effective, high volume production process for durable press and shrinkage control treatment of cellulosic fiber-containing fabrics and garments made from such fabrics still has eluded those skilled in this art. It is clearly evident that the elimination of the need for close control over moisture content of the fabric and simplified one-step application of moisture, cross linking agent and catalyst in predetermined quantities would be highly desirable, since it would leave few other variables to be controlled, such as the time of exposure of the fabric to the cross linking agent and catalyst, the curing temperature and the curing time. It is also highly desirable that a treating process of the type under consideration be carried out at ambient (i.e. room) temperature if possible to reduce energy consumption and to simplify the controls needed to carry out the process. Finally, an ideal process would use an absolute minimum of cross linking agent to carry out the necessary treatment, thereby reducing cost for the chemicals and simplifying cleaning procedures used to remove non cross linked chemical from the treated fabric.

BRIEF SUMMARY OF THE INVENTION

The present invention overcomes the problems of prior art processes for treating cellulosic fiber-containing fabrics and articles made therefrom, and in particular solves the problem of conveying cellulosic cross linking agent, catalyst and moisture to the fabric in a simple yet efficient process. In accordance with the invention, a cellulosic fiber-containing fabric and articles made therefrom are treated with a cellulosic cross linking agent in the presence of a catalyst and moisture to provide controlled shrinkage and durable press properties to the fabric. This is carried out in accordance with the invention by transporting at least the cross linking agent and moisture to the fabric in the form of an aerosol mist that has been generated from a mixture of water and cross linking agent. Preferably, a liquid catalyst also comprises part of the aerosol mist, so that the aerosol mist is constituted of minute droplets each containing cellulosic cross linking agent, water and catalyst.

Accordingly, each droplet of the aerosol mist contains the entire cross linking system of cross linking agent, moisture and catalyst in a form that can be readily and rapidly absorbed into the fibers of the fabric. The amount of cross linking agent and catalyst absorbed can be controlled by regulating the quantity of aerosol mist transported to the fabric and also by controlling the time of exposure of the fabric to the aerosol mist. After exposure of the fabric to the cross linking agent, moisture and catalyst-containing aerosol mist, curing (i.e., cross linking) proceeds in a conventional manner by heating the fabric with its absorbed cross linking agent, moisture and catalyst.

The invention contemplates carrying out the process by exposing individual batches of fabric articles to the aerosol mist in a reaction chamber and also contemplates a process for continuously treating running fabric lengths. In addition, the invention contemplates treating individual or batches of fabric articles in a continuous process by running the articles through appropriate treating and heating chambers in sequence.

The advantages of the process are numerous. The entire process of exposing the fabric to the cellulosic cross linking agent and catalyst can be carried out conveniently at room (i.e., ambient) temperature and the amount of cross linking agent required to effectively achieve the treatment is drastically reduced. Therefore, energy consumption to achieve the process is reduced in accordance with the invention and cleaning of residual cross linking agent from the fabric is simplified and under ideal conditions eliminated, with less waste of cross linking agent.

Optionally, the liquid droplets constituting the aerosol mist may only include the cellulosic cross linking agent and moisture, while the catalyst can be introduced to the fabric in a gaseous state either preceding or following its exposure to the aerosol mist comprising cross linking agent and water. While the benefits of the invention are maximized when the aerosol mist is used as the vehicle for both the cross linking agent and the catalyst, in some instances it may be desirable to use a gaseous catalyst in combination with the aerosol mist.

In accordance with another aspect of the invention, a liquid catalyst alone can be applied to the fabric as an aerosol mist independently of the cross linking agent, which can be transported to the fabric by a separate aerosol mist to achieve still further controls over the process.

It has also been discovered that the use of an aerosol mist comprising droplets of water alone can be used to effectively clean residual chemicals, in particular cross linking agent, from the fabric after the curing step. In addition, an aerosol mist can be utilized to transport other treating agents to the fabric, for example, wetting agents or hand building agents in liquid form or other treating chemicals can be introduced to a fabric in the form of an aerosol mist wherein each of the droplets contains the chemical treating agent.

Thus, it can be seen that the broad concept of utilizing an aerosol mist, which is essentially a fog, for chemically treating a fabric with a cellulosic cross linking agent, catalyst and moisture, simultaneously or in separate events, with or without separate chemical treating and cleaning of a fabric using aerosol mist containing appropriate chemical agents or moisture, has a distinct advantage in that the problems of the prior art related to transporting chemical agents to the fabric in precise concentrations in an energy efficient manner are overcome in a very simplified and efficient manner. Essentially, all that is required is a quantity of liquid chemical agent and atomizing nozzles for the agent capable of generating a suspension of minute droplets of the liquid agent in air in the presence of the fabric to be treated. The fabric then absorbs the droplets without requiring a condensation effect and without requiring careful metering of various agents into a reaction chamber with the hope that all the agents will reach the fabric in the desired concentrations within a predetermined time period. Each and every droplet of the aerosol mist in accordance with the present invention contains the necessary chemicals to perform the desired treating of the fabric so that essentially the treating process becomes dependent only on time of exposure of the fabric to the aerosol mist after the mist has been generated. The time of exposure is easily controllable by simply blowing the aerosol mist away from the fabric by ventilating a chamber or moving the fabric away from the aerosol mist. The process likewise becomes independent of the moisture content of the fabric at the initiation of the treating process and is likewise virtually independent of temperature of the fabric or the atmosphere surrounding the fabric. Vaporization of solid cross linking agent and its attendant maintenance problems are eliminated. Unlike prior art processes using steam as a vehicle for the cross linking agent, the low temperature process using aerosol mist in accordance with this invention ensures that immediate absorption of moisture droplets by the fabric occurs without the need for condensation of moisture from the steam. The lower temperature of the process eliminates problems encountered in prior art processes where the high temperature steam prevented ready absorption of moisture into the fabric due to the high temperature of the fabric.

These and other objectives and advantages of the invention will become apparent from the ensuing Detailed Description of the Invention.

DESCRIPTION OF THE DRAWINGS

With reference to the appended drawings:

FIG. 3 schematically illustrates a process for continuously treating articles made from cellulosic fiber-containing fabric in a continuous process.

DETAILED DESCRIPTION OF PREFERRED EMBODIMENTS OF THE INVENTION

With reference to the drawings, the apparatus aspects of the invention will first be described with reference to the accompanying drawings.

Figure 1:
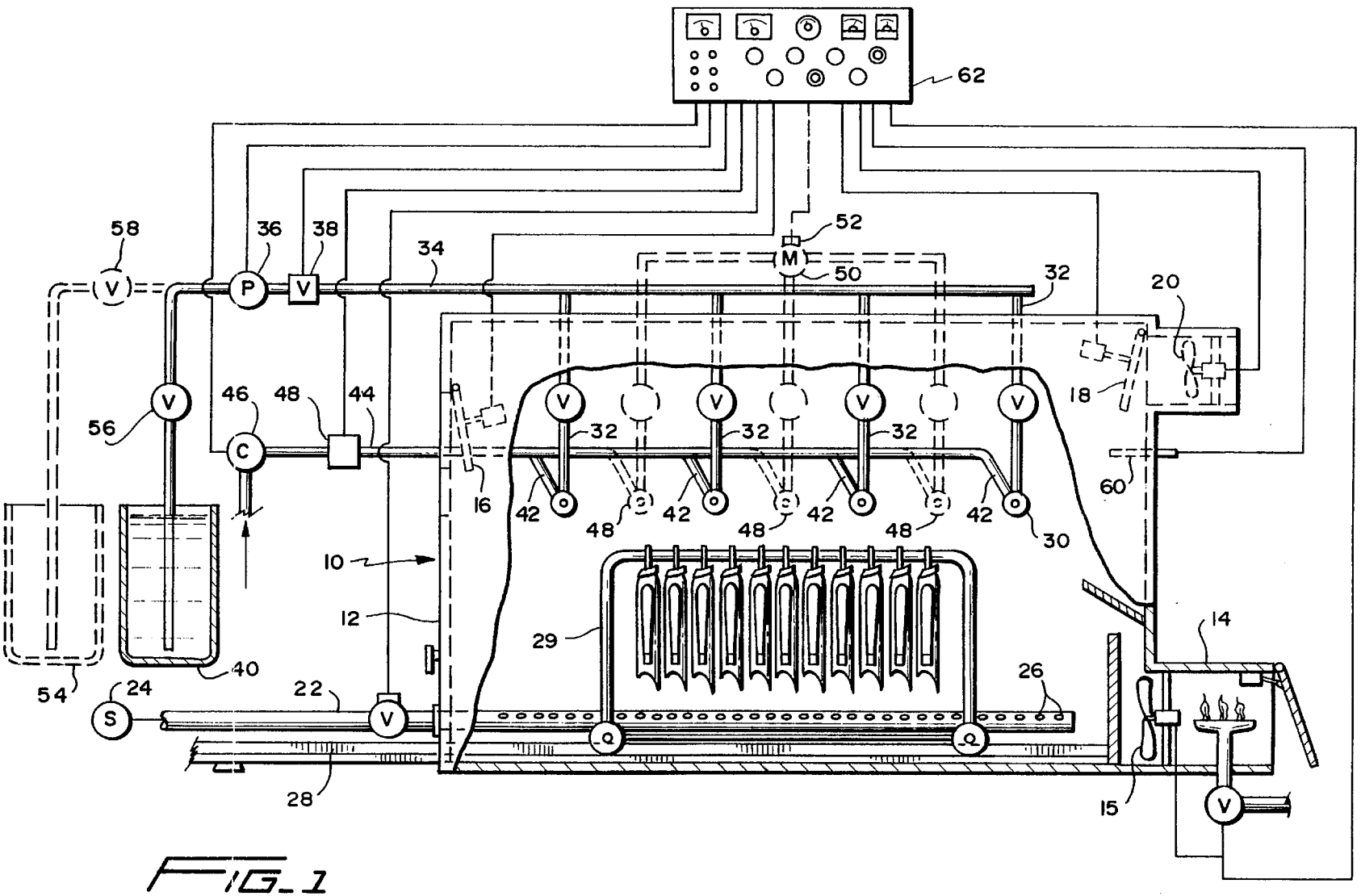
FIG. 1 schematically illustrates apparatus for carrying out a process for treating cellulosic fiber-containing fabric and articles made therefrom in accordance with the present invention.

In FIG. 1, a treating or reaction chamber 10 comprises an enclosure constructed of, for example, stainless steel or any other appropriate material resistant to moisture and chemicals used in carrying out the processing of treating cellulosic fabrics or fabric articles in accordance with this invention. The reaction chamber 10 includes a door 12 for accessing the interior of the chamber and for admitting and withdrawing articles into and out of the chamber 10. A heater 14 and (optionally) a blower 15 are provided for heating the interior of the chamber rapidly at least up to cross linking temperature, which will be discussed more fully below. Vent doors 16 and 18 with associated actuators and a venting blower 20 are provided for rapidly venting the interior of chamber 10 and admitting fresh air into the chamber.

A steam supply pipe 22 is provided for admitting steam into the interior of chamber 10, the pipe 22 extending from a supply of steam 24 to the interior of the chamber. The end of pipe 22 within the chamber 10 is provided with suitable outlet ports 26 for the steam conveyed by pipe 22.

A track or rail system 28 extending through door 12 is provided to enable carts 29, dollies or other transport systems carrying fabric articles to be treated into and out of chamber 10 in a convenient manner.

Atomizing nozzles 30 are provided in the chamber 10, for example along opposed sidewalls of the chamber, although the nozzles can be provided at any convenient location suitable for generating an aerosol mist within the chamber 10. A suitable nozzle, for example, would be an atomizing nozzle sold by Spraying Systems Company of Cincinnati, Ohio, under catalogue No. SU 13A-SS which utilizes compressed air to break up a pressurized input liquid stream and inject it into atmosphere as a fine aerosol mist of minute droplets of the liquid. Pressurized liquid is supplied to the nozzles 30 via conduits 32 extending from header 34 which is in communication with pump 36 and control valve 38. Both pump 36 and control valve 38 are electrically controlled and operated in the preferred mode of the invention.

Pump 36 draws liquid from holding tank 40 and discharges the liquid into header 34 for eventual supply to nozzles 30 under the control of valve 38, which regulates flow through the header 34.

Compressed air is also supplied to nozzles 30 through air conduits 42 which communicate with air manifold 44 which receives compressed air from compressor 46 when the compressor is activated. An appropriate valve 48 may be provided between the compressor 46 and nozzles 30 for controlling the flow of compressed air supplied to the nozzles 30 or for regulating the pressure of such compressed air.

Optionally, a second set of atomizing nozzles 48 shown in phantom lines may be provided in chamber 10, with such nozzles communicating with a manifold 50 and including appropriate control valving 52 for supplying a liquid chemical to the nozzles 48 that may be different from liquid supplied to nozzles 30. The nozzles 48 may share the same air source 46 with nozzles 30, or optionally (not illustrated) a separate compressor and air duct system can be provided to supply compressed air to atomizing nozzles 48.

Optionally, one or more holding tanks 54 in addition to primary holding tank 40 may be provided with appropriate valving 56, 58 to enable pump 36 to draw different liquids (separately or simultaneously) and supply same to nozzles 30. In addition (not illustrated) pump 36 can communicate with both nozzles 30 and 48 so that, with appropriate controls over valving 56, 58 and other appropriate valves, pump 36 could supply one liquid to nozzles 30 from tank 40 and another liquid to nozzles 48 from tank 54.

A temperature sensor 60 for sensing temperature in chamber 10 or other suitable means for sensing such temperature is provided.

The various arrangements of elements including heater 14, blower 15, venting doors 18, blower 20 and temperature sensor 60 are illustrated only schematically and do not correspond necessarily with the locations of such elements in an actual chamber 10 used for treating fabric articles. In an actual reaction chamber, these items would be suitably located to optimize their particular function depending upon the articles to be treated, the size of the chamber and the operating parameters of the process carried out in the chamber, all of which would be known to persons skilled in the art in view of the description of structure and function provided herewith. For example, circulation of heated air within chamber 10 by blower 15 could be arranged in any suitable fashion, including using strategically located ducts and baffles to ensure that the interior of chamber 10 is uniformly heated to the desired temperature as rapidly as possible by heater 14. A simple baffle arrangement is illustrated as exemplary only.

A central control panel 62 enables an operator to monitor and control all aspects of operation of the reaction chamber 10 and the peripheral components associated therewith. While the operation of the reaction chamber can be monitored and controlled centrally via the control panel 62, it should be apparent that the individual components of the system can be manually operated and controlled as well. In the preferred embodiment, all of the components are electrically controllable from a central control panel 62, with appropriate instrumentation and sensors, such as, for example, temperature probe 60, providing information to the central control panel 62 to enable an operator to observe all aspects of the operation of the reaction chamber from a central location.

Figure 2:
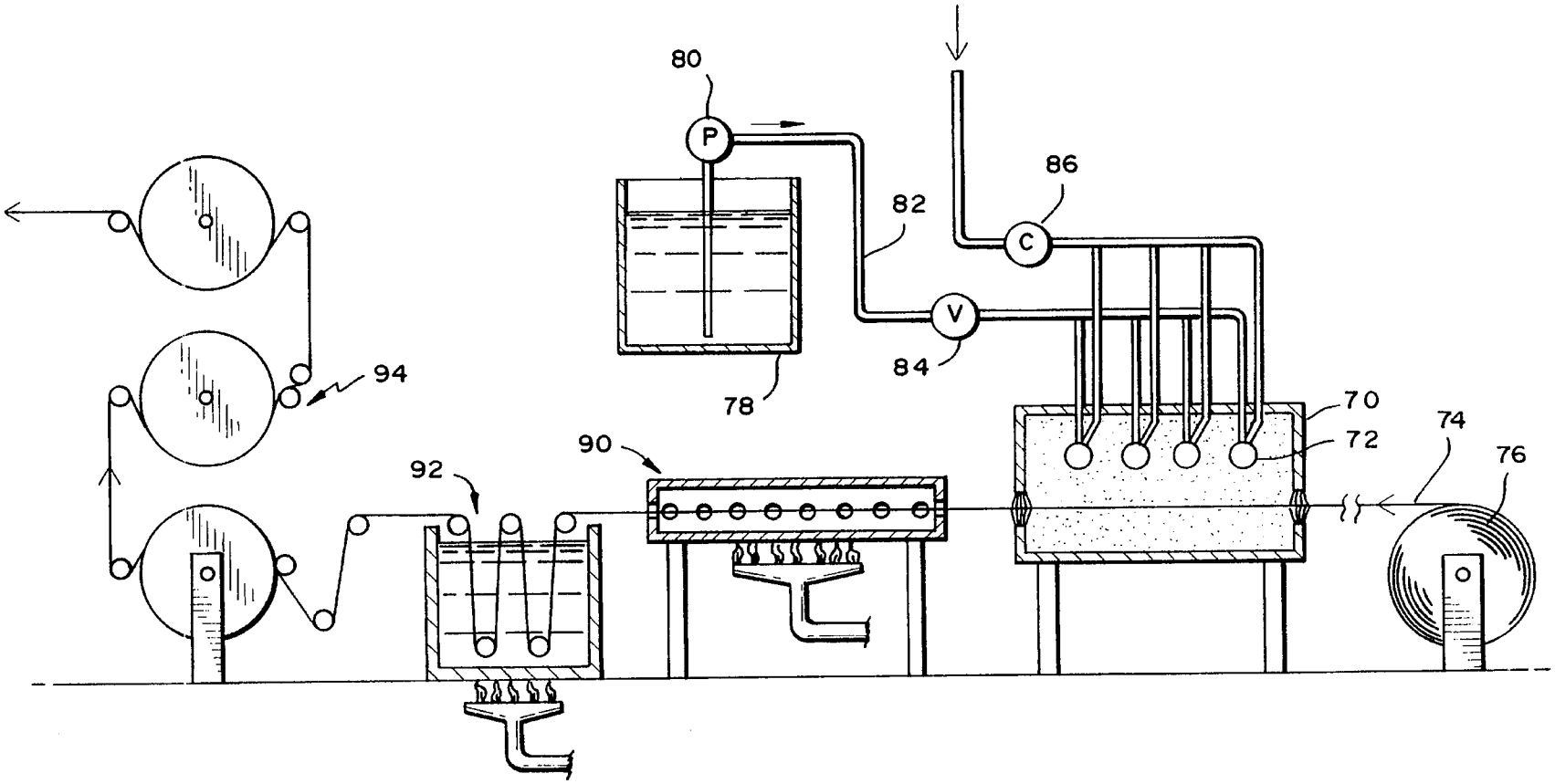
FIG. 2 schematically illustrates apparatus for carrying out a process of treating continuous fabric in accordance with this invention.
Figure 9:
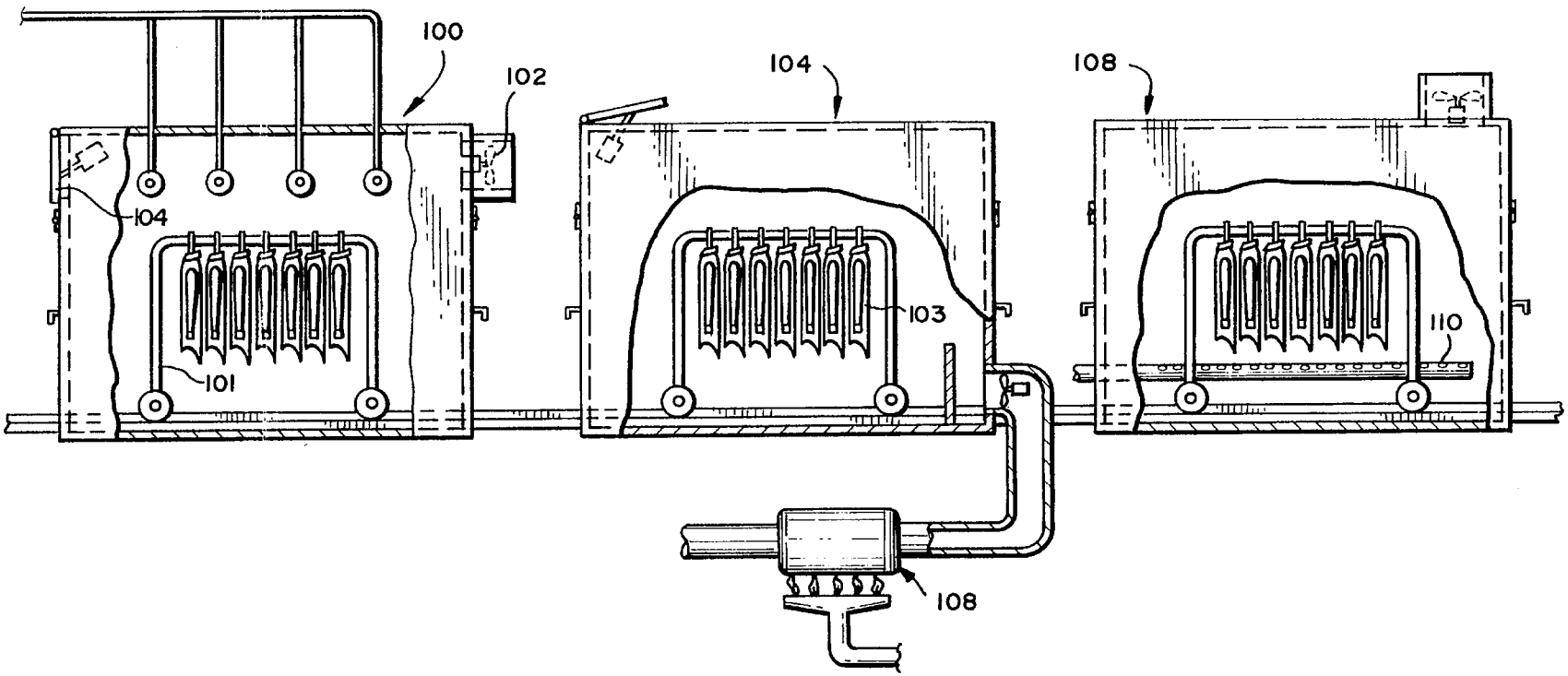

Continuing with the description of the apparatus of the invention, FIG. 2 illustrates a process for treating cellulosic fiber-containing fabric to provide at least controlled shrinkage properties for the fabric and, to the desired extent, wrinkle resistance properties for the fabric as well. In accordance with the embodiment illustrated in FIG. 2, a treating chamber 70 defines a confined treating zone within the chamber in which an aerosol mist as described previously in connection with FIG. 1 is generated. Atomizing nozzles 72 are provided in reaction chamber 70 to generate an aerosol mist within the treating zone in chamber 70. Chamber 70 is configured to receive and process a continuous web of cellulosic fiber-containing fabric 74 extending from a supply roll 76. If desired, pretreating chambers could be provided upstream of chamber 70 to pretreat fabric web 74 before the web reaches the chamber 70. For example, an additional chamber (not illustrated) could be provided to moisten or precondition fabric web 74 upstream of treating chamber 70.

The aerosol nozzles 72, in accordance with this exemplary embodiment, may be provided with a mixture of cross linking agent and catalyst provided in tank 78 and pumped to the nozzles 72 by a pump 80 through conduit 82, preferably with a flow control valve 84 regulating flow of liquid through the conduit. Compressed air may be supplied to the atomizing nozzles 72 by means of compressor 86. Thus, upon the supply of both compressed air and liquid to the nozzles 72, an aerosol mist will be generated within the chamber 70 in the same manner as is generated by nozzles 30 in the FIG. 1 embodiment of the invention.

Downstream of the treating chamber 70, which may be considered as a single treating station, a second treating station 90 is provided which may comprise a conventional tenter arranged to heat the fabric to the cross linking temperature of the cross linking agent while an appropriate spreading tension is applied to the fabric across its width. Again, if desired, an intermediate treating station could be provided between the treating chamber 70 and the heating station 90 to achieve any desired effect on the moving fabric web. For example, it may be desirable in certain instances to only expose the fabric 74 to a cross linking agent in the treating chamber 70, while the catalyst is applied to the fabric at a separate treating chamber (not illustrated) between chamber 70 and heating station 90. Alternatively, it may be advantageous in some instances to apply the catalyst to the fabric at a station upstream of the treating chamber 70 between the chamber and the supply roll 76. The important consideration here is that the chamber 70 is supplied with an aerosol mist having a sufficient quantity and concentration of cross linking agent to suitably cross link the cellulosic fiber in the fabric 74 to the desired extent using a minimum of cross linking agent. Accordingly, the length of the chamber 70 and the speed of movement of fabric 74 through the chamber 70 will need to be designed in such a manner that the fabric 74 will have the opportunity to absorb a suitable quantity of cross linking agent (and catalyst, if supplied simultaneously in the aerosol mist) as the fabric traverses the chamber 70.

While not illustrated, chamber 70 would be provided with suitable instrumentation and perhaps temperature control means (neither illustrated) in the same manner as reaction chamber 10 discussed previously. The schematic illustration provided in FIG. 2 is intended to depict the essential apparatus used to create an aerosol mist in the chamber 70 so that a person skilled in the art could readily understand the manner in which the invention is carried out.

Downstream of the heating station 90, a hot water (or other purging medium) rinse bath 92 is provided for rinsing off any excess, non-reacted cross linking agent and other free chemicals from the fabric 74. After the fabric passes through the hot water bath 92, it is passed over a series of heating drums 94 which heat the fabric progressively up to a maximum of approximately 400° F. to both dry the fabric to an appropriate moisture content and to drive off by vaporization any residual cross linking agent or other chemical that may have remained on the fabric after it has passed through the hot water bath 92.

While the rinse bath 92 has been characterized as being hot water, it should be understood that the rinse bath could be any appropriate chemical, including, water, that would be suitable to remove non-reacted or free chemicals from the fabric 74. The bath of the rinse solution at station 92 also could be adjusted depending upon the free chemicals to be separated from the fabric. While a hot water bath has been schematically illustrated and described, a steam chamber also could be provided in lieu of the hot water bath if desired to effectively remove chemical agents from the moving fabric 74.

In accordance with the embodiment of the invention illustrated in FIG. 3, apparatus is illustrated for continuously treating individual batches of articles made from cellulosic fiber-containing fabric. In this embodiment, a treating chamber 100 is provided and generally resembles the reaction chamber 10 shown in the embodiment of FIG. 1. However, in this embodiment the chamber 100 is only used to expose the fabric articles 103 to an aerosol mist wherein the droplets comprise a mixture of water and cross linking agent, with perhaps a catalyst. As in the embodiment of FIG. 1, the cross linking agent and water could be supplied by a pump (not shown) along with compressed air via air conduits (not illustrated) to generate an aerosol mist of water and cross linking agent in chamber 100. Optionally, the catalyst also may be supplied in liquid form to the nozzles 98 so that the droplets of the aerosol mist each comprise a mixture of cross linking agent, moisture and catalyst. Appropriate ventilation means such as a blower 102 and a vent door 104 may be provided to enable rapid ventilation of the interior of chamber 100 to limit the time of exposure of the fabric articles 103 to the aerosol mist generated by nozzles 98 in the chamber 100. Other appropriate sensors, conduits and accessories have not been illustrated in connection with treating chamber 100, but it should be understood that appropriate instrumentation and control systems would be provided in connection with the treating chamber 100, the same as described previously in connection with reaction chamber 10 in FIG. 1. Additional nozzles (not illustrated) could be provided to separately supply a solution of catalyst in the form of an aerosol mist in chamber 100 independently of the cross linking agent, or the catalyst could be supplied via a pipe (not shown) communicating with the interior of the treating chamber 100.

A curing station 104 is located downstream of chamber 100 and it will be noted that, in accordance with the invention, appropriate closures would be provided to enable the articles 103 mounted on an appropriate vehicle 106 to be moved as a unit from chamber 100 to chamber 104. Appropriate rails, tracks or surfaces would be provided, including an appropriate conveyor means if desired, for moving the articles 103 from one work station to the next in a series of stations intended to completely treat the fabric articles.

At the curing station 104, an appropriate heating system 108 would be provided to quickly heat the interior of the chamber and the fabric articles therein to bring the fabric up to cross linking temperature with minimum delay and under close control through appropriate monitoring equipment. Any appropriate heating system for the chamber could be utilized, and an exemplary embodiment illustrated comprises an open combustion chamber through which air is moved by an appropriate blower to heat the interior of the curing station 104.

As with previous embodiments of the invention, any number of pretreating or post treating stations could be provided on either side of treating station 100 and curing station 104. The preferred embodiment only illustrates a treating station and a curing station for the sake of simplicity.

Downstream of the curing station 104, a cleaning station 108 is provided for cleaning free chemical from the fabric articles 103. In this particular embodiment, a source of steam 110 is utilized as the cleaning medium, but any other suitable cleaning system could be provided at this station.

The methodology underlying the invention will now be described. In operation, and with reference first to the embodiment of the apparatus illustrated in FIG. 1, finished and pressed articles of clothing such as shirts to be treated to provide shrinkage resistance and durable press properties to the garments would be loaded on an appropriate transporting system such as trolley 29 individually suspended from hangers or the like in a manner enabling free circulation of atmosphere around the garments. The trolley 29 is then moved into the chamber 10 and the chamber is substantially sealed by closing the vent doors 16 and 18. A preconditioning steam treatment involving supply of steam to the interior of chamber 10 via conduit 22 to expose the garments to a steam atmosphere to relax the fiber and remove residual wrinkles from the garments would then be carried out for an appropriate time cycle. The interior of the chamber would then be ventilated by opening the vent door 16, 18 and activating vent blower 20 to replace the high humidity atmosphere with fresh air and to reduce the temperature in the chamber. If desired, a suitable chemical could then be injected into the chamber to adjust the alkalinity of the fabric to condition it for receiving the cellulosic cross linking agent in a manner to be described below. For example, if the fabric is a cotton or cotton blend, sulphur dioxide or ammonia gas could be admitted into the chamber 10 by appropriate means (not illustrated) to adjust the alkalinity of the cotton fabric to neutral or slightly acid, assuming that a formaldehyde cross linking agent is intended for use in the treating process.

A wetting agent or surfactant can also be provided to the interior of chamber 10, either with steam as the vehicle for the agent or by utilizing nozzles 48 to generate an aerosol mist of the wetting agent or surfactant. Appropriate softening agents or hand builders can also be provided to the interior of chamber 10 via the steam supply conduit 22 or via nozzles 48 from an appropriate supply in communication with manifold 50.

When all of the preconditioning steps are completed, all free chemicals are ventilated from the chamber 10 by the vent blower 20 to restore an atmosphere of fresh air within the chamber 10 in preparation for the admission of cross linking agent and catalyst to the chamber.

The nozzles 30 are then activated by supplying compressed air to the nozzles from compressor 46 and pump 36 is activated to supply liquid cross linking agent under pressure to the nozzles 30. Valves 48 and 38, of course, would be controlled via panel 62 to permit the desired operation of the nozzles 30. Preferably, a liquid catalyst and cross linking agent would be supplied simultaneously from holding tank 40 via pump 36 and conduit 34 to nozzles 30 to thereby result in the generation of an aerosol mist in chamber 10 comprising minute droplets that each includes at least water, liquid cellulose cross linking agent and liquid cross linking promoting catalyst into the chamber for absorption by the fabric of the garment articles being treated. The generation of aerosol mist is controlled for an appropriate length of time to thoroughly fill the chamber 10 and to provide an adequate supply of cross linking agent and catalyst to the fabric at a rate consistent with the rate of absorption of the chemicals into the fabric of the articles. Ambient temperature is preferred throughout the step of generating the aerosol mist in the chamber 10 so that the temperature of the fabric exposed to the aerosol mist is substantially ambient. Alternatively, cross linking agent alone can be supplied from holding tank 40 to the nozzles 30, while a liquid catalyst is separately supplied either before or after the cross linking agent via the nozzles 30 or 48. Still another option available is to inject a gaseous catalyst into the chamber 10 either prior to or subsequent to the injection of the aerosol mist of cross linking agent into the chamber so that the fabric receives both cross linking agent and catalyst in suitable proportions over a predetermined length of time that is established to ensure that a minimum of cross linking agent is supplied to the fabric articles to achieve the desired shrinkage resistance and durable press properties desired for the fabric and no more. Thus, in accordance with this process injection of the aerosol mist and catalyst into the chamber 10 would only be carried out for a predetermined length of time consistent with these objectives until the fabric had absorbed sufficient quantity of chemicals to carry out the subsequent cross linking of the cellulosic fiber with the cross linking agent in a manner that will result in properly treated fabric having a minimum of residual non-cross linking agent and other free chemicals which would need to be ultimately removed from the fabric.

The time of exposure of the garments to the aerosol mist preferably is controlled by timing the length of injection and quantity of aerosol mist injected into the chamber 10 via the nozzles 30 and by ventilating the chamber rapidly by means of blower 20 and venting doors 16, 18 after a suitable soak period has transpired with the fabric articles exposed to the droplets of the aerosol mist. Ventilation of the chamber results in admission of fresh air which completely fills the chamber and effectively stops the absorption of cross linking agent by the fabric of the articles undergoing treatment. The articles are now ready for the curing process, which ensues. The temperature within the chamber 10 is now increased by the heating system 14, 15 until an appropriate cross linking temperature is reached in the chamber. Generally, the cross linking temperature is in the range of 200°–400° F. if a formaldehyde cross linking agent is used to cross link natural cotton. Upon transpiration of an appropriate curing time dependent upon the fabric undergoing treatment, the heating system is deactivated. Residual cross linking agent and other chemicals present in the fabric of the garment articles can be cleaned by, for example, steam injection via steam conduit 22 or by injection of an appropriate cleansing solution via nozzles 48, with the solution in the form of an aerosol mist. Finally, the chamber is cooled, the atmosphere in the chamber is substituted essentially with fresh air and the now cross linked and cleansed fabric articles are removed from the chamber for final processing in accordance with any desired final processing procedure.

With reference to FIG. 2, the method aspects of the invention involve generating an appropriate aerosol mist atmosphere of cross linking agent, optionally with cross linking promoting catalyst, in chamber 70 and then advancing the cellulosic fiber-containing fabrics 74 through the chamber 70 at a controlled rate so that absorption of the droplets of the aerosol mist by the fabric takes place over a predetermined period of time to provide a desired concentration of cross linking agent and catalyst in the cellulosic fibers of the fabric. The process is carried out at room temperature the same as in the embodiment of FIG. 1 and it is to be understood that, if desired, pretreatment of the fabric can occur upstream of the chamber 70 to condition the fabric in any desired manner in accordance with known processing techniques.

The fabric is then advanced from the chamber 70 to the curing station 90 where the fabric is heated to cross linking temperature while held in a gently stretched condition over a period of time sufficient to achieve cross linking between the cross linking agent and the cellulosic fiber of the fabric 74. Following cross linking, the fabric 74 is advanced to the cleaning and drying stations 92,94, as previously described.

It should be understood that the aerosol mist in chamber 70 could contain only cross linking agent, with the catalyst being supplied to the fabric either upstream or downstream of the chamber 70 by any suitable means, including a separate aerosol mist, liquid bath, in gaseous form or by spraying.

The method aspects involving the apparatus illustrated in FIG. 3 are self-evident from the description of the apparatus provided above, but it should be understood that the exposure of the fabric articles 103 in chamber 100 essentially corresponds with the exposure to the aerosol mist described above in connection with the embodiment of FIG. 1. In this embodiment, duplicate batches of fabric articles 103 can be mounted on appropriate trolleys or carts 101 for treatment while moving through a series of treatment stations in a continuous process. Preconditioning of the fabric articles can occur upstream of the chamber 100 or within the chamber 100 itself, in the same manner as described previously in connection with the embodiment of FIG. 1. Within the chamber 100, it is essential that the fabric articles are exposed to an aerosol mist comprising at least liquid cross linking agent and moisture and optionally with a catalyst incorporated in the droplets of the aerosol mist. Control over the absorption of cross linking agent into the fabric is provided by a ventilation system in accordance with the preferred form of the invention, but any other suitable means or process could be utilized to ensure that the absorption of cross linking agent into the fabric is cut off after a suitable length of time and after a suitable amount of cross linking agent has been injected into the chamber 100. After exposure of the fabric articles to the aerosol mist in chamber 100 and following a predetermined soak period in a fresh air atmosphere in chamber 100 (or a separate area if desired), the fabric articles 103 are transported to a subsequent treating station, in this instance a curing station 104 where they are heated to achieve cross linking of the cellulosic fibers and the cross linking agent in the presence of the catalyst agent. After cross linking, the fabric articles are then transported to the cleaning station 108 for cleaning of residual chemicals from the fabric articles. It should be understood that, as the first batch of articles is moved from the chamber 100 to the cross linking station 104, another batch of articles is moved into the chamber 100 for a repetition of the process just described above wherein the articles are disposed to the aerosol mist droplets for a period sufficient to result in absorption of the fabric of cross linking agent and catalyst sufficient to ultimately provide the shrinkage resistance and durable press properties for the fabric articles.

As with previous embodiments of the invention, various other pretreating, conditioning or reaction chambers could be provided on either side of chambers 100, 104 and 108. For the sake of simplicity, only these three treating chambers have been described as an exemplary embodiment.

There now follows examples of the inventive process and the results achieved thereby.

EXAMPLE 1

An airtight stainless steel reaction chamber measuring approximately 6 feet wide by 10 feet long by 7 feet high is provided with a single entry door, six aerosol nozzles (catalog number SU 13 A-SS supplied by Spraying Systems Co., Cincinnati, Ohio) positioned along opposite lateral sides of the chamber, three to a side, a pair of longitudinally extending steam supply pipes with steam outlet openings, fresh air inlet and outlet ports with controllable closures, an air blowing fan for ventilation of the chamber, an open combustion gas heater and hot air circulation system for heating the chamber interior, a supply tank for liquid chemical solution, a pump and conduit system for supplying the liquid chemical solution to the aerosol nozzles, an air compressor and conduit system for supplying compressed air to the aerosol nozzles, a steam supply at 60 PSI connected to the steam pipes, and gas injection nozzles for supplying gaseous chemical to the interior of the chamber. A central control panel is wired to the liquid pump, compressor, and fan air inlet and outlet port closures, as well as various solenoid operated flow control valves provided in the liquid chemical solution, air, steam and gaseous chemical supply conduits. A microprocessor is incorporated in the control panel and is programmed to control timing of various portions of the treatment cycles to be carried out in the chamber. The liquid chemical supply tank is calibrated to provide a measuring system for indicating quantity of chemical solution supplied to the aerosol nozzles. Specifically, a translucent tank is provided with volume graduations in English unit increments (i.e. feet and inches) and, through calibration tests, it is determined that the tank holds 0.36 gallons of chemical per inch of vertical height (approximately 1.36 liters/in. or 0.54 liters/cm.). Shrinkage properties of fabric samples are determined by measuring control fabric samples before and after one or more household laundering cycles along the weft and warp (length and width, respectively) directions, and comparing the measurements with corresponding measurements for similar fabric samples exposed to a cross linking process in the chamber. In the household laundering cycle used for determining shrinkage properties, a normal warm wash and cold rinse cycle is used. Strength loss properties for fabric samples are determined by using a standard ball burst tester (Mullen Tester) to measure fabric strength in a control sample and comparing the measurement with the strength of a similar fabric sample after exposure to a cross linking process in the chamber. Wrinkle or crease resistance of fabric samples is measured by the American Association of Textile Colorists and Chemists Test Procedure No. AATCC Test Method 124-1984: "Appearance of Durable Press Fabrics After Repeated Home Laundering". Essentially, the fabric is laundered as described above and dried using standard home laundry drying equipment with a durable press (permanent press) cycle. The fabric is then permitted to relax for a predetermined period of time and its surface appearance is compared with a chart, yielding a durable press rating (D.P.) of 1 to 5, 5 being the highest rating. Residual non-reacted formaldehyde cross linking agent in treated fabric samples is determined by a standard AATCC Test Method 112-1984: "Formaldehyde Odor in Resin-Treated Fabric, Determination of: Sealed Jar Method.".

A 100% cotton twill pure finish sample of fabric measuring approx. 18 in.×24 in. having a known strength before treatment is placed in the chamber and the chamber is closed to ambient atmosphere. An aerosol of 37% solution formaldehyde (37% formaldehyde, 15% methanol, balance water) diluted 1 to 1 with plain water is injected for a duration of one minute into the chamber at room temperature until ¼ inch of solution has been consumed to generate the aerosol mist, this amount corresponding to 17 grams of solution evenly dispersed throughout the entire chamber in the form of fine suspended droplets. Following injection of the aerosol, sulphur dioxide gas used as a cross linking catalyst is injected through discharge nozzles into the chamber until 15 lbs. (6.8 kg) of gas is dispensed in the chamber. The fabric is exposed to the formaldehyde aerosol mist and catalyst gas for 2 minutes, following which the chamber is purged of the mist and catalyst through the air outlet port and filled with fresh air admitted through the air inlet port using a fan to force the exchange of atmosphere in the chamber. The temperature in the chamber is then elevated to 260 ° F., which takes about 5 minutes, and the fabric is steam cleaned using steam at 60 PSI for five minutes. The sample is then removed from the chamber, laundered once using the home laundry equipment with a standard normal wash cycle (warm wash, cool rinse) and dried using a permanent press cycle. Testing indicates that shrinkage of the fabric sample is 5% in the warp direction, 0% weftwise, as compared with normal shrinkage of 10% warpwise and 0% weftwise for untreated fabric. Loss of strength of the treated fabric as compared with untreated fabric is 0% warpwise, 33% weftwise. Residual non-reacted formaldehyde content in the fabric sample is 345.5 ppm. The D.P. measurement of the sample shows a rating of 3.25.

EXAMPLE 2

Using the same equipment, chemicals, treating cycle, and testing procedures as used in Example 1, an 18 in. by 24 in. sample consisting of 100% pure finish cotton "80 square" fabric shows that shrinkage in the warp direction is 3% and in the weft direction 2½%, as compared with 5% and 6.25%, respectively, for untreated fabric. Loss of strength is 38% warpwise, 15% weftwise as compared with an untreated sample. Residual non-reacted formaldehyde content is 150 ppm. The D.P. rating is 2.75 for this sample.

EXAMPLE 3

Using the same equipment, chemicals, treating cycle, and test procedures as used in Example 1, a sample consisting of 100% cotton ticaro pique knit fabric measuring approximately 18 in. by 24 in. shows that shrinkage in the warp direction is 12% and in the weft direction 11%, as compared with 20% and 2.5%, respectively, for untreated fabric. Loss of strength is 19% as compared with an untreated sample. Residual non-reacted formaldehyde content is 405.5 ppm. The D.P. rating is 4 for this sample.

EXAMPLE 4

Using the same treating and testing equipment as Example 1, a liquid cross linking and liquid catalyst solution consisting of 280 gms. of the 37% formaldehyde solution described in Example 1,160 gms. of standard catalyst CAT. No. 9, 8,250 gms. of water, and 18 gms. of standard wetting solution sold under the trademark PROTOWET is prepared and placed in the liquid solution supply tank. Samples of 100% cotton "80 square" and 100% cotton jersey fabrics measuring approximately 18 in. by 24 in. are placed in the chamber, and an aerosol mist of the solution just described is then generated at room temperature in the chamber by injecting same through the aerosol nozzles for three minutes, which discharges ¾ in. of solution (51 gms.) into the chamber. The samples are then exposed at room temperature to the aerosol mist in the chamber for two minutes, following which the chamber is rapidly purged of chemicals and filled with fresh air. The chamber temperature is elevated to 320° F., to cross link the fabric, and the fabric is then cleaned using steam under 60 PSI for five minutes. The fabric samples are cooled and removed from the chamber, laundered and dried in the same manner described in Example 1 and tested for shrinkage and strength loss. The "80 square" fabric shows shrinkage of 2.5% warpwise, 2.5% weftwise, as compared with untreated shrinkage values of 5% and 6.25%, respectively. Strength loss is 30% warpwise, 34% weftwise as compared with an untreated sample. The jersey sample shrunk 9% in length and 1% in width as compared with 15% and 6% respectively for an untreated sample. The strength loss of the jersey sample was 16%.

EXAMPLE 5

Using the same treating and testing equipment and chemical solution formula as described in Example 4, a sample of 100% cotton twill is exposed to an aerosol mist generated in the chamber in the same manner as Example 4. The sample is exposed to the aerosol mist for a soak period of four minutes, followed by purging of the chamber, substituting fresh air for the aerosol mist, and then heating, curing, steam cleaning and laundering the sample, in the same manner as Example 4. Upon testing, the fabric shows 4% shrinkage warpwise, 0% weftwise, as compared with 10% and 0%, respectively, for an untreated sample. Strength loss of the sample is 0% warpwise, 19% weftwise.

EXAMPLE 6

Using the same treating and testing equipment and chemical solution formula as described in Example 4, a sample of 100% cotton ticaro pique is exposed to an aerosol mist injected into the chamber for 2½ minutes, resulting in the dispersement in the chamber of 5/8 in. (43 gms.) of chemical solution in the form of an aerosol mist of minute droplets. The fabric sample is exposed to the aerosol mist for a soak period of four minutes, and then the chemical mist is replaced by fresh air. The sample is then heated up to 320° F. to cross link the fabric, followed immediately by steam cleaning for five minutes using steam at 60 PSI. The sample is laundered using the same cycle as described in Example 1 and, upon testing, the fabric shows a shrinkage of 14% lengthwise, 2.5% widthwise, as compared with an untreated sample shrinkage of 20% lengthwise and 2.5% widthwise. Strength loss is 19% using this procedure.

It will thus be apparent that a process has been described for treating cellulosic fiber-containing fabric with a suitable cross linking agent to provide shrinkage resistance and durable press properties for the fabric that overcomes many of the problems encountered in prior art techniques. The use of an aerosol mist wherein each minute droplet carries cross linking agent directly to the fabric for absorption thereby with moisture and optionally a cross linking promoting catalyst finds no counterpart in the prior art whatsoever. The concept of utilizing a chemical treatment system wherein each individual droplet of a fine aerosol mist contains the essential ingredients for carrying out a cross linking process provides distinct advantages over the prior art in terms of reduction in quantities of chemicals needed to effectively treat the cellulosic fibers, with other incidental advantages such as simplification of the cleaning process to remove excess cross linking agent from the fabric. Since the quantity of cross linking agent required to achieve effective cross linking is drastically reduced, little non-cross linking agent remains on the fabric for later removal. The ability to carry out the exposure of the fabric to cross linking agent at room temperature provides still another advantage in terms of energy consumption, since heat is not required to generate steam to be used as a vehicle for the cross linking agent nor is it necessary to provide heat to vaporize a normally solid cross linking agent in the treating or reaction chamber.

Another advantage of the process is that all of the conditioning of the fabric can be carried out utilizing aerosol mist containing minute droplets of various liquid chemical compounds in a sequential series of steps with ventilation of the aerosol mist from the chamber between each step. Likewise, cleaning of the fabric after cross linking also can be achieved using an aerosol mist comprising water or other scavaging chemicals in desired proportions and concentrations. Thus, a very simple yet effective apparatus is able to carry out transporting of cross linking agent and other chemicals to continuous fabric or finished fabric articles in a highly effective and efficient manner that avoids the need to be concerned with the moisture content of the fabric or fabric articles, eliminates the problem of transporting different chemicals to the fabric in suitable proportions and concentrations, and permits an entire process to be carried out essentially using a simple set of atomizing nozzles with appropriate plumbing and ventilation arrangements to achieve control over the process.

While specific embodiments of the apparatus and process of the invention have been described, it is to be understood that the descriptions are exemplary only and it is intended that the invention be limited only by the scope of the claims appended hereto.

We claim:

1. Apparatus for treating a fabric article containing cellulosic material including a treating chamber, comprising:

aerosol generating means for introducing a liquid aerosol mist into the chamber;

means for supplying liquid cellulosic cross linking agent to the aerosol generating means for introduction into the chamber as at least part of the aerosol mist;

means for controlling the quantity of aerosol mist introduced into the chamber; and means for supplying liquid cross linking promoting catalyst to the aerosol generating means simultaneously with the cross linking agent for introduction into the chamber as part of the aerosol mist.

2. Apparatus as claims in claim 1, including a vent system means for rapidly venting cross linking and catalyst agents that have not been absorbed by the fabric article from the chamber.

3. Apparatus as claimed in claim 1, including means for supplying steam to the interior of the chamber.

4. Apparatus as claimed in claim 1, including means for supplying substantially only water aerosol mist into the chamber.

5. Apparatus as claimed in claim 1, including means for introducing a gaseous cross-linking promoting catalyst into the chamber.

6. Apparatus as claimed in claim 1, wherein said aerosol generating means includes a source of compressed air and at least one aerosol discharge nozzle in the chamber, and means for supplying said compressed air and the cross-linking agent to the nozzle for discharge into the chamber in the form of said aerosol mist.

7. Apparatus as claimed in claim 1, wherein said liquid cross-linking agent comprises an aqueous solution.

8. Apparatus as claimed in claim 1, wherein said chamber includes heating means for heating the chamber interior up to a temperature corresponding to the cross-linking temperature for cellulosic material and said cross-linking agent.

9. Apparatus for treating a fabric article containing cellulosic material including a treating chamber, comprising:

aerosol generating means for introducing a liquid aerosol mist into the chamber;

means for supplying liquid cellulosic cross linking agent to the aerosol generating means for introduction into the chamber as at least part of the aerosol mist;

means for controlling the quantity of aerosol mist introduced into the chamber; and a vent system means for rapidly venting cross linking and catalyst agents that have not been absorbed by the fabric article from the chamber.

10. Apparatus for treating a fabric article containing cellulosic material including a treating chamber, comprising:

first aerosol generating means for introducing a first liquid aerosol mist into the chamber;

means for supplying liquid cellulosic cross linking agent to the first aerosol generating means for introduction into the chamber as at least part of the first aerosol mist;

means for controlling the quantity of first aerosol mist introduced into the chamber;

a second aerosol generating means for introducing a second liquid aerosol mist into the chamber; and means for supplying a liquid cellulosic cross linking agent to the second aerosol generating means for introduction into the chamber as at least part of the second aerosol mist.

11. Apparatus for treating a fabric article containing cellulosic material including a treating chamber, comprising:

aerosol generating means for introducing a liquid aerosol mist into the chamber;

means for supplying liquid cellulosic cross linking agent to the aerosol generating means for introduction into the chamber as at least part of the aerosol mist;

means for controlling the quantity of aerosol mist introduced into the chamber; and means for supplying steam to the interior of the chamber.

12. Apparatus for treating a fabric article containing cellulosic material including a treating chamber, comprising:

aerosol generating means for introducing a liquid aerosol mist into the chamber;

means for supplying liquid cellulosic cross linking agent to the aerosol generating means for introduction into the chamber as at least part of the aerosol mist;

means for controlling the quantity of aerosol mist introduced into the chamber; and means for supplying substantially only water aerosol mist into the chamber.

13. Apparatus for treating a fabric article containing cellulosic material including a treating chamber, comprising:

aerosol generating means for introducing a liquid aerosol mist into the chamber;

means for supplying liquid cellulosic cross linking agent to the aerosol generating means for introduction into the chamber as at least part of the aerosol mist;

means for controlling the quantity of aerosol mist introduced into the chamber; and means for introducing a gaseous cross-linking promotion catalyst into the chamber.

14. Apparatus for treating a fabric article containing cellulosic material including a treating chamber, comprising:

aerosol generating means for introducing a liquid aerosol mist into the chamber;

means for supplying liquid cellulosic cross linking agent to the aerosol generating means for introduction into the chamber as at least part of the aerosol mist;

means for controlling the quantity of aerosol mist introduced into the chamber;

wherein said aerosol generating means includes a source of compressed air and at least one aerosol discharge nozzle in the chamber; and means for supplying said compressed air and the cross-linking agent to the nozzle for discharge into the chamber in the form of said aerosol mist.

15. Apparatus for treating a fabric article containing cellulosic material including a treating chamber, comprising:

aerosol generating means for introducing a liquid aerosol mist into the chamber;

means for supplying liquid cellulosic cross linking agent to the aerosol generating means for introduction into the chamber as at least part of the aerosol mist;

means for controlling the quantity of aerosol mist introduced into the chamber; and wherein said cross-linking agent comprises an aqueous solution.

16. Apparatus for treating a fabric article containing cellulosic material including a treating chamber, comprising:

aerosol generating means for introducing a liquid aerosol mist into the chamber;

means for supplying liquid cellulosic cross linking agent to the aerosol generating means for introduction into the chamber as at least part of the aerosol mist;

means for controlling the quantity of aerosol mist introduced into the chamber; and wherein said chamber includes heating means for heating the chamber interior up to a temperature corresponding to the cross-linking temperature for cellulosic material and said cross-linking agent.

* * * * *